US009901166B2

(12) United States Patent
Fifield

(10) Patent No.: US 9,901,166 B2
(45) Date of Patent: Feb. 27, 2018

(54) HAND PUMP CLEANING BRUSH

(71) Applicant: Joshua Cowan Fifield, Greenacres, WA (US)

(72) Inventor: Joshua Cowan Fifield, Greenacres, WA (US)

( * ) Notice: Subject to any disclaimer, the term of this patent is extended or adjusted under 35 U.S.C. 154(b) by 0 days.

(21) Appl. No.: 14/962,161

(22) Filed: Dec. 8, 2015

(65) Prior Publication Data

US 2016/0157596 A1 Jun. 9, 2016

Related U.S. Application Data

(60) Provisional application No. 62/088,686, filed on Dec. 8, 2014.

(51) Int. Cl.

| | |
|---|---|
| ***A46B 11/00*** | (2006.01) |
| ***A45D 34/04*** | (2006.01) |
| ***A47L 1/15*** | (2006.01) |
| ***A46B 7/04*** | (2006.01) |
| ***B05B 11/06*** | (2006.01) |
| ***A47L 17/00*** | (2006.01) |
| ***A47L 13/17*** | (2006.01) |
| ***A46B 13/08*** | (2006.01) |

(52) U.S. Cl.

CPC ..... *A46B 11/0055* (2013.01); *A46B 7/04* (2013.01); *A46B 13/08* (2013.01); *A46B 2200/3033* (2013.01)

(58) Field of Classification Search

CPC ..... A47L 17/04; A46B 11/00; A46B 5/02; A46B 7/04; B05B 15/02

USPC ..... 401/188 R

See application file for complete search history.

(56) References Cited

U.S. PATENT DOCUMENTS 2,772,430 A * 12/1956 Moritt ..... A47L 17/00 15/111
2,982,443 A * 5/1961 Ellis ..... B05B 11/3011 222/1
3,246,361 A * 4/1966 Blackmon ..... A46B 5/00 132/308
3,612,706 A * 10/1971 Verga ..... A46B 11/0017 401/190
4,072,254 A * 2/1978 Cox ..... B05C 17/0123 222/391
4,254,738 A * 3/1981 Stanley ..... A01K 13/002 119/604

(Continued)

*Primary Examiner* — Allana Lewin Bidder
*Assistant Examiner* — Thomas M Abebe
(74) *Attorney, Agent, or Firm* — Timberline Patent Law Group PLLC

(57) ABSTRACT

A hand pump cleaning brush is provided. In an implementation, a cleaning brush converts liquid cleaner in a reservoir to a lather of cleaning foam through mechanical action provided by the user. An example cleaning brush may include a handle connected to a removable bristle block. A liquid reservoir is contained within the handle and stores the liquid cleaner. The reservoir is connected to a piston driven pump and/or valve that produces foam, for example, by aeration with ambient air through a mesh. A finger trigger provides pumping force. In an implementation, the foaming pump or valve draws air and liquid cleaner into a chamber and dispenses these to the brush head through a fine mesh screen, which aerate the liquid cleaner into a foam at the brush head. A rotary locking device with a push button can allow the head to swivel on the handle.

12 Claims, 7 Drawing Sheets

(56) References Cited

U.S. PATENT DOCUMENTS 4,793,019 A * 12/1988 Stima ..... A47L 13/146 15/104.94
4,826,340 A * 5/1989 Rothweiler ..... A46B 7/04 401/205
5,393,153 A * 2/1995 Bouthillier ..... A46B 11/0058 401/146
5,823,206 A * 10/1998 Mapleback ..... A45D 34/04 132/317
5,890,829 A * 4/1999 Hesse ..... A46B 11/0024 222/391
6,325,564 B1 * 12/2001 Knowles ..... A45D 34/042 401/171
6,425,701 B1 * 7/2002 Jacobs ..... A46B 11/0013 401/206
6,786,431 B2 * 9/2004 Song ..... A46B 11/0079 239/289
7,040,830 B2 * 5/2006 Kliegman ..... A46B 11/0013 401/187
7,478,960 B2 * 1/2009 Glover ..... A46B 11/0055 401/188 R
7,682,097 B2 * 3/2010 Knopow ..... A47L 1/15 401/136
7,832,955 B1 * 11/2010 Leffew ..... A46B 11/0055 401/188 R
8,152,400 B2 * 4/2012 LaFlamme ..... A47L 13/17 401/187
9,247,805 B1 * 2/2016 Malm ..... A46B 11/002
2005/0191116 A1 * 9/2005 Flanery ..... A47L 1/15 401/272
2005/0199265 A1 * 9/2005 France ..... A46B 9/00 134/6
2007/0274762 A1 * 11/2007 Edwards ..... A46B 5/0016 401/39
2010/0200675 A1 * 8/2010 Tu ..... B05B 11/3011 239/428.5
2013/0048755 A1 * 2/2013 Uehira ..... B05B 11/0018 239/318
2013/0149021 A1 * 6/2013 Kast ..... A01M 21/043 401/146
2015/0258559 A1 * 9/2015 Baughman ..... B05B 7/0037 222/135

* cited by examiner

HAND PUMP CLEANING BRUSH

RELATED APPLICATIONS

This patent application claims the benefit of priority to U.S. Provisional Patent Application No. 62/088,686 filed Dec. 8, 2014, and incorporated herein by reference in its entirety.

BACKGROUND

Conventional cleaning brush products for washing dishes or hard surfaces require liquid cleaner and water to develop a lather of cleaner on the brush head. Conventional cleaning brushes provide a liquid cleaner reservoir built into the handle of the brush. The liquid cleaner, such as soap, is often dispensed by way of gravity through a small hole in the head of the brush. The liquid cleaner can leak out of the head of the brush when the brush is not in use, especially when some form of check valve is not built into the brush. Other conventional cleaning brushes incorporate a small rubber button on the liquid reservoir that acts as a displacement device when pushed into the reservoir. The button, when pressed, occupies space in the reservoir that compresses the liquid cleaner forcing it out of the opening in the brush head. As the soap level in the reservoir is lowered during use, the displacement button becomes ineffective because the air in the reservoir makes the compression ineffective. The increased compressibility of the air requires an increased displacement to eject any cleaner, which the button cannot provide.

Known brushes also require an external use of water and agitation by the user to generate a lather of cleaner foam on the object that is being cleaned. A separate supply of water can be unwieldy or unavailable, as clean water is not always available when cleaning objects during travel, in a car, or outside, as when camping. Moreover, cleaning in tight spaces, such as inside a drinking glass can be difficult with conventional fixed-head cleaning brushes because the head is invariably angled and cannot make flat contact with the bottom of the glass, for example.

SUMMARY

A hand pump cleaning brush is described. An example brush that dispenses foaming soap provides a metered quantity of foam cleaner at the actuation of a finger trigger mounted on the brush handle. As the example brush dispenses liquid cleaner as a foam lather, the need for water outside of the example cleaning brush to generate a lather is eliminated. An example foaming valve includes a check valve that eliminates soap leakage. In an implementation, a removable brush head allows the brush bristles to be replaced without replacing the entire device. In an implementation, a clear viewing window with marked gradients allows the user to mix proper amounts of cleaner products and identifies the amount of liquid cleaner remaining in the reservoir. In an implementation, a push-button rotary locking device on the brush head allows the brush head to be swiveled at different angles.

This summary is not intended to identify key or essential features of the claimed subject matter, nor is it intended to be used as an aid in limiting the scope of the claimed subject matter.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

DETAILED DESCRIPTION

This disclosure describes example hand pump cleaning brushes. The example cleaning brush generates a foam of cleaning lather from liquid cleaner in a reservoir by mechanical force provided by the user.

Figure 1:
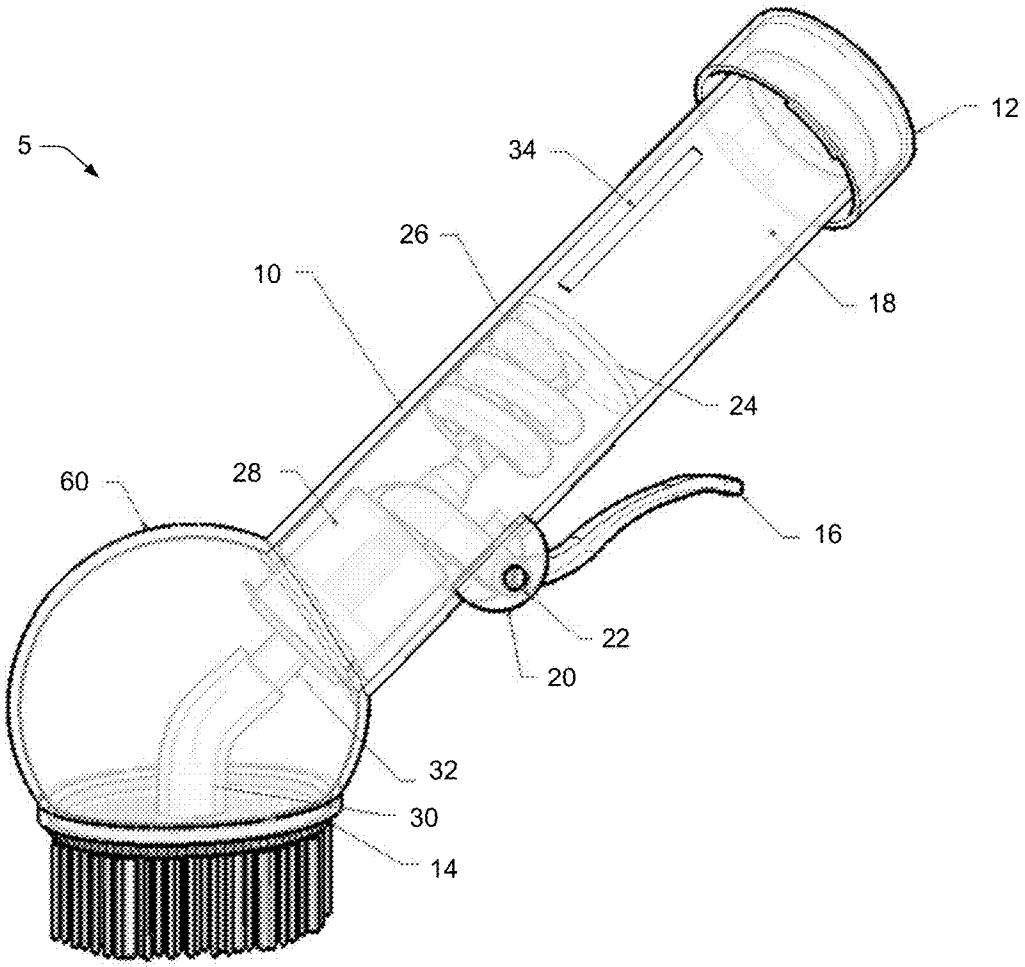
FIG. 1 is a diagram of an example side view of the example cleaning brush with a transparent outer shell and a fixed reservoir.

FIG. 1 is a side view of an example cleaning brush 5 with a transparent outer shell and a fixed reservoir. In an implementation, a liquid cleaner is poured into the liquid reservoir 18 by unscrewing a threaded reservoir cap 12. The shell of the liquid reservoir 18 has a transparent viewing window 34 that may include gradient markings so that a mixture of the liquid cleaner can be made.

In an implementation, the brush handle 10 may be a hollow cylinder, which has an attached yoke 20 that joins the finger trigger 16 to the brush handle 10. The finger trigger 16 may have a hollow sleeve that allows the finger trigger 16 to pivot around the fixed shaft 22 that is attached to the yoke 20.

An example bristle block 14 can be threaded at its base so that the bristle block 14 can be removed from an example bush head 60 of the example cleaning brush 5 by screwing off the bristle block 14. The base of the bristle block 14 and body of the example cleaning brush 5 can be shaped in various ways to provide a sharp edge for scraping stuck food or debris from the surface being cleaned.

Figure 2:
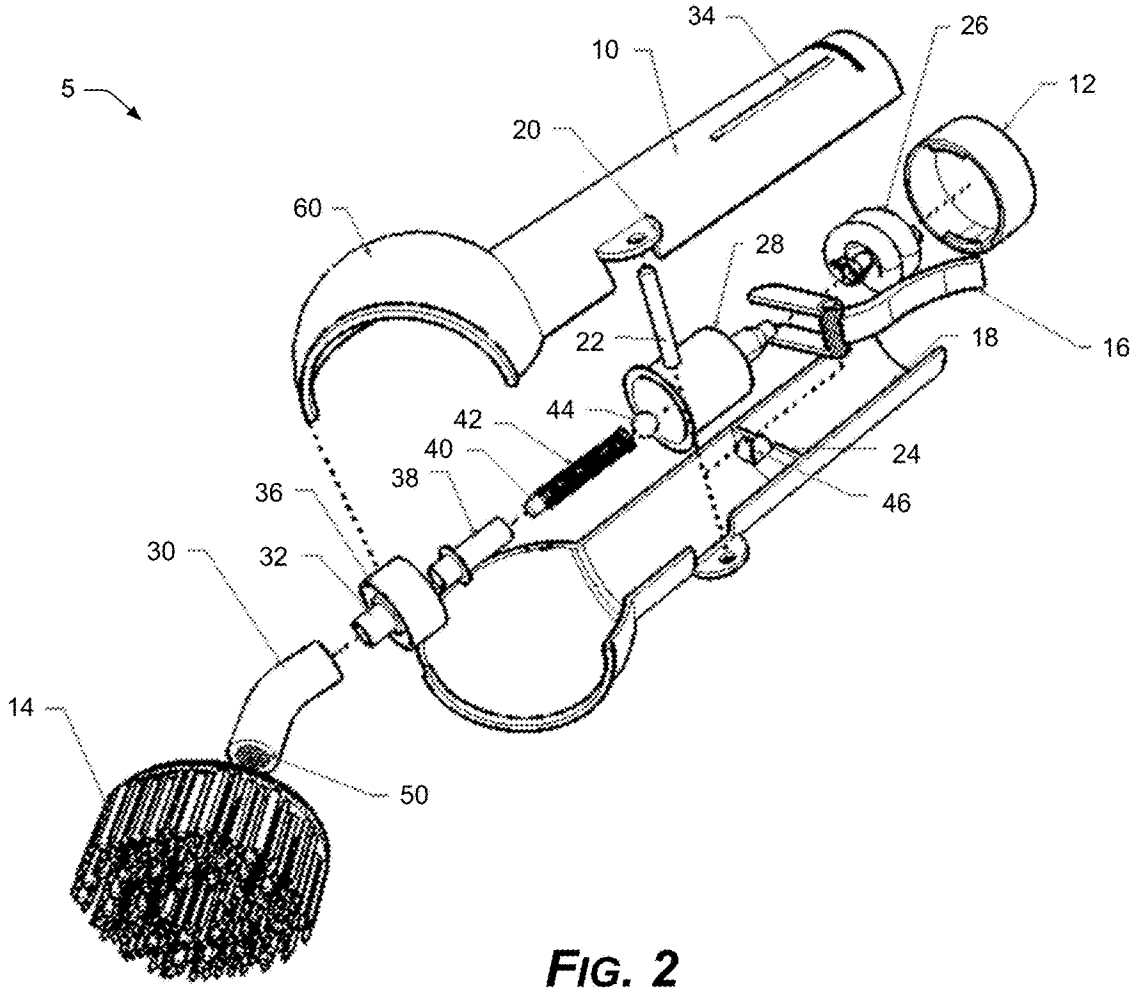
FIG. 2 is an isometric exploded view of the example cleaning brush with a fixed reservoir.

FIG. 2 is an isometric exploded view of the example cleaning brush 5 with a fixed reservoir. The liquid reservoir 18 containing the liquid cleaner has a partition 24 separating the liquid cleaner from the hollow body of the brush handle 10. The partition 24 may have a nipple 46 attached that allows the liquid cleaner to feed into a coiled flexible tubing 26. The coiling of the flexible tubing 26 allows an outer casing of a foam pump 28 to move back and forth while maintaining a connection to the reservoir 18. The other end of the coiled flexible tubing 26 is attached to an inlet on the moveable outer casing of the foam pump 28. The foam pump 28 is comprised of the moveable outer casing that houses a steel ball 44, an upper check valve 40, a helical spring 42, a liquid piston 38, an air piston 36, and a mixing chamber 32. When the finger trigger 16 is pulled or actuated, the lever arm of the trigger 16 pressed against the base of the moveable outer casing of the foam pump 28 forces the outer casing of the foam pump 28 over the fixed piston 36 thereby causing the fixed piston 36 to retract into the foam pump 28. The liquid piston 38 and the fixed air piston 36 draw the liquid cleaner and ambient air into the mixing chamber 32 and push the air/cleaner mixture through the discharge tube 30 to a hole in the bristle block 14. The end of the discharge tube 30 has a fine mesh screen 50 that aerates the air/cleaner mixture into a foam when forced through by the pressure supplied by the user through the finger trigger 16. When the finger trigger 16 is released, the helical spring 42 expands, forcing the steel ball 44 back into the inlet nipple 46 of the foam pump 28, stopping the flow of liquid cleaner into the pump 28. The helical spring 42 also pushes the movable outer casing of the foam pump 28 back so that the fixed air piston 36 is back in an extended position with respect to movable outer casing of the foam pump 28.

Figure 3:
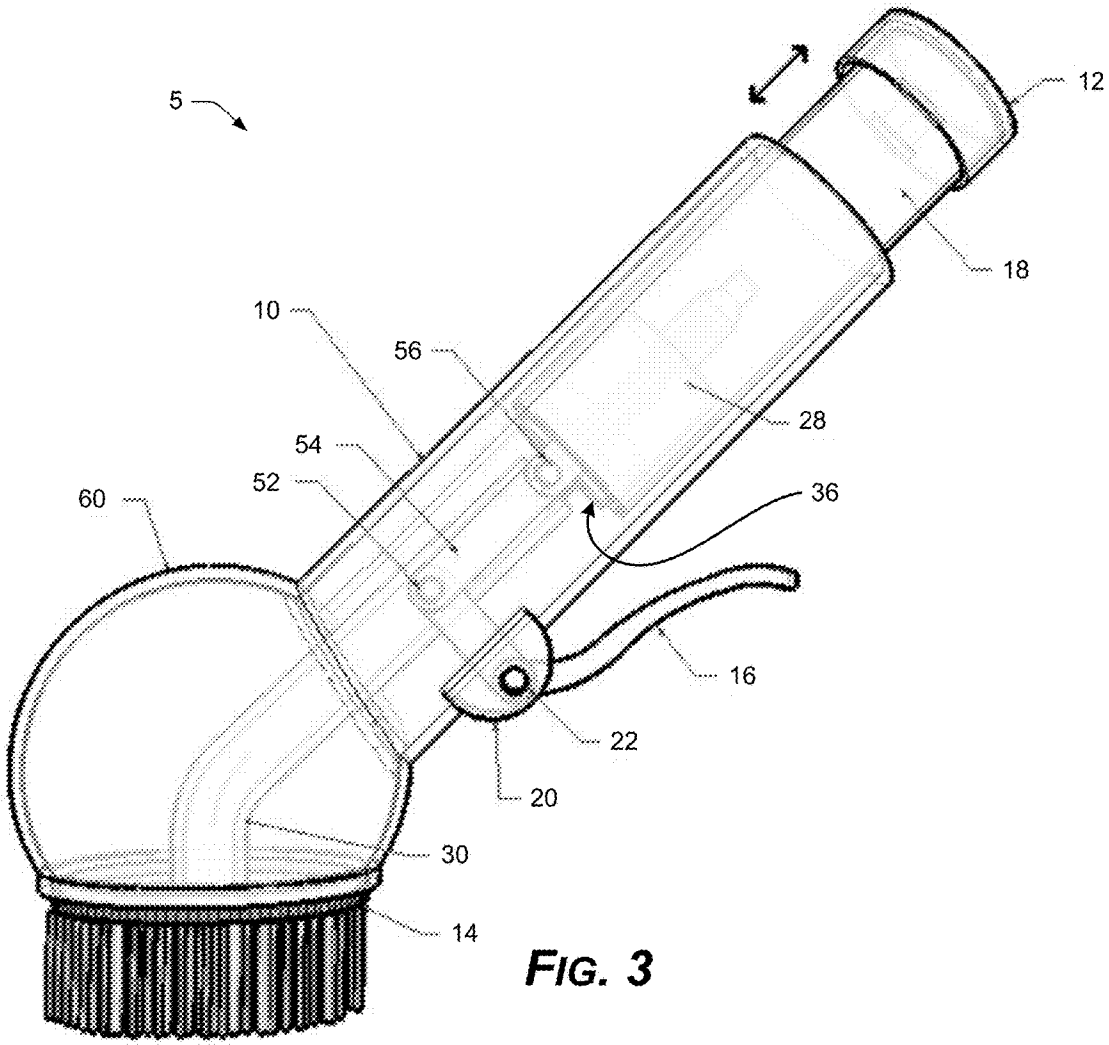
FIG. 3 is a side view diagram that shows an example cleaning brush with a transparent outer shell and sliding reservoir.

FIG. 3 is a side view of another implementation of an example cleaning brush 5 that shows a transparent outer shell and sliding reservoir 18. In this embodiment, the liquid reservoir 18 is separated from the brush handle 10 and moves back and forth during operation of the foam pump 28. The brush handle 10 has a larger diameter than the liquid reservoir 18 to act as a sleeve around the reservoir 18.

Figure 4:
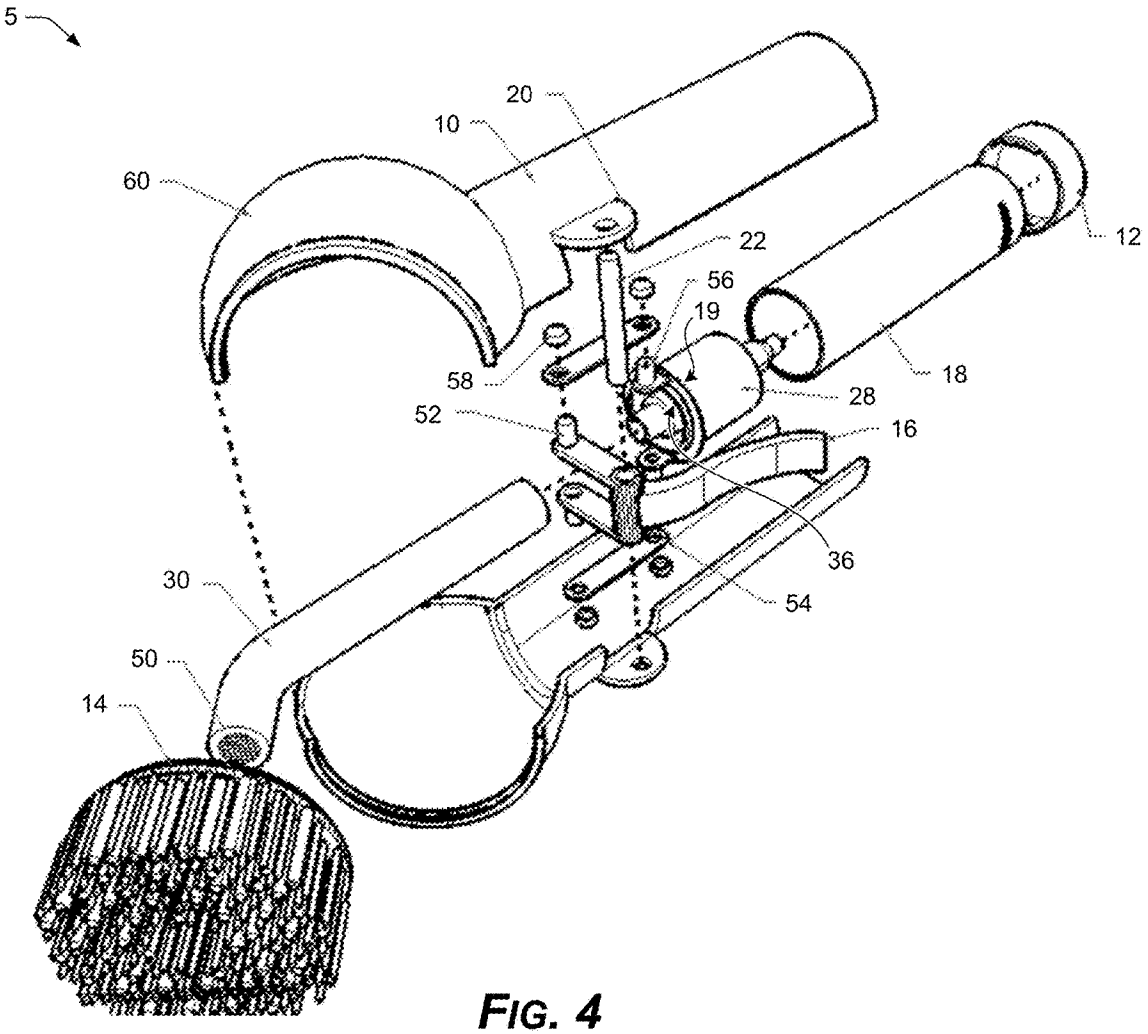
FIG. 4 is an isometric exploded view that shows an example cleaning brush with a sliding reservoir.

FIG. 4 is an isometric exploded view showing the example cleaning brush 5 with a sliding reservoir 18. The liquid reservoir 18 is sealed to a flange on the outer casing of the foam pump 28. A linkage pin 56 can be attached perpendicularly to the pump flange 19 on each side. A linkage arm 54 connects the foam valve linkage pin 56 to another linkage pin 52 on the lever arm of the finger trigger 16. The linkage arm 54 is kept in place on the pins by the locking caps 58. The discharge tube 30 is attached to the brush head 14 and the mixing chamber 32. When the finger trigger 16 is pulled, the lever arm of the finger trigger 16 and connected linkage arm 54 pull the outer casing of the foam pump 28 and liquid reservoir 18 into the brush handle 10. Movement of the foam pump 28 outer casing over the fixed pistons 36 & 38 draws the liquid cleaner from the reservoir 18 and discharges the air/cleaner mix through the discharge tube 30 to the bristle block 14.

Figure 5:
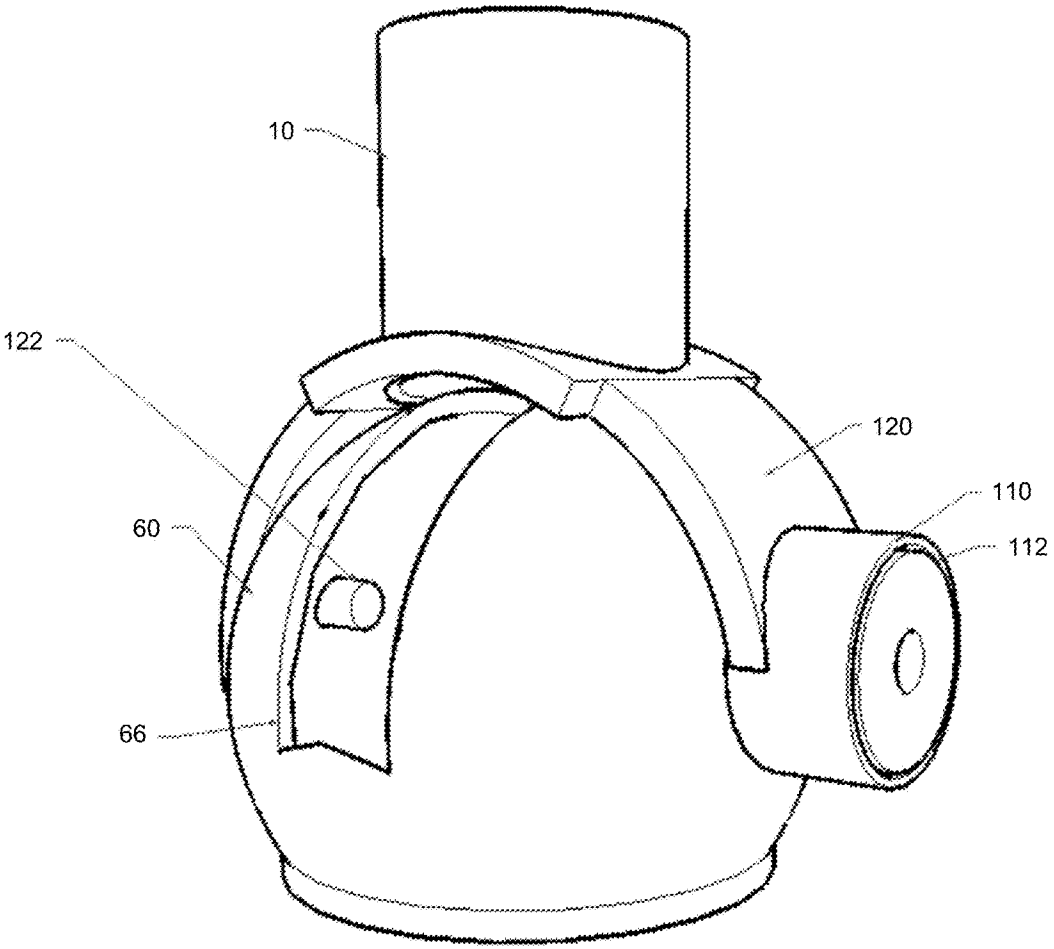
FIG. 5 is an isometric view of an example cleaning brush with a rotating head.

FIG. 5 is an isometric view that showing a rotating head of the example cleaning brush 5. In an implementation, the brush handle 10 has two socket arms 120 that are used to attach to the brush head 60 by a head pin 122 on one side and a rotary locking device 110 on the other side. The rotary locking device 110 is unlocked by a push button 112, which when pressed allows the brush head 60 to swivel at different angles. A slot 66 is cut in the brush head 60 to allow the discharge tube 30 to move with the brush handle 10.

Figure 6:
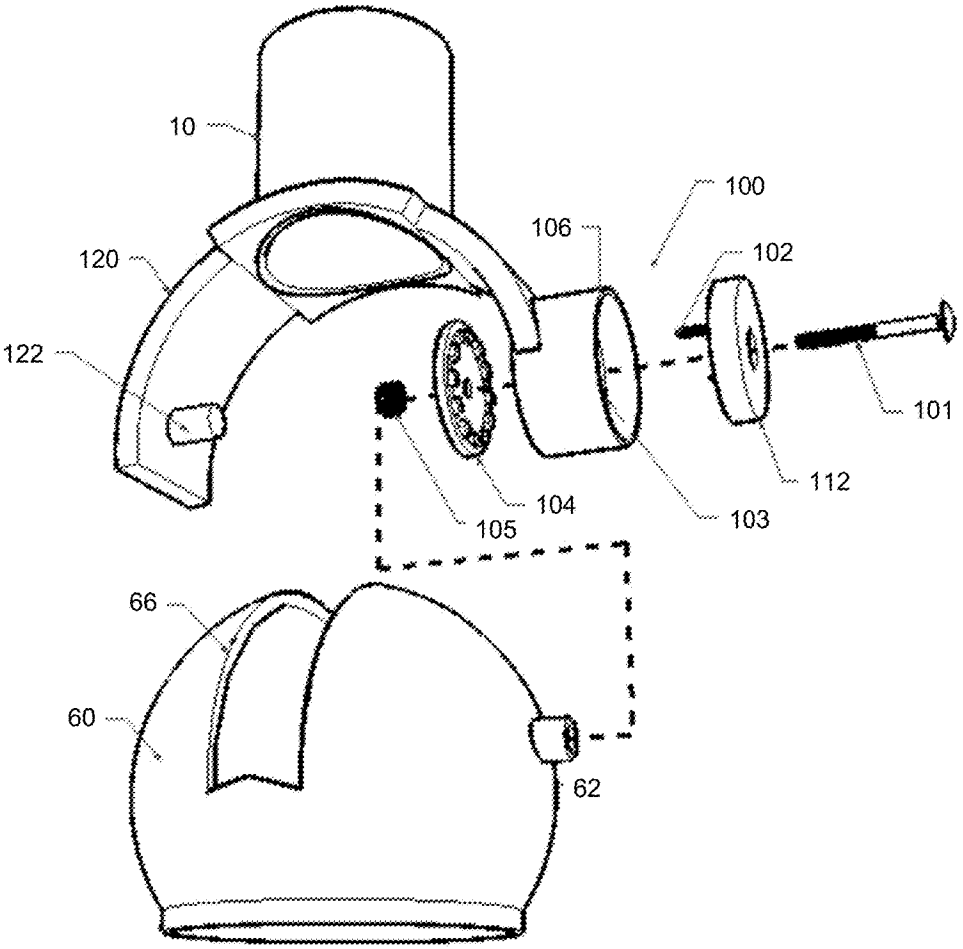
FIGS. 6 and 7 are isometric exploded views of an example cleaning brush with a rotating head at different angles of view.
Figure 7:
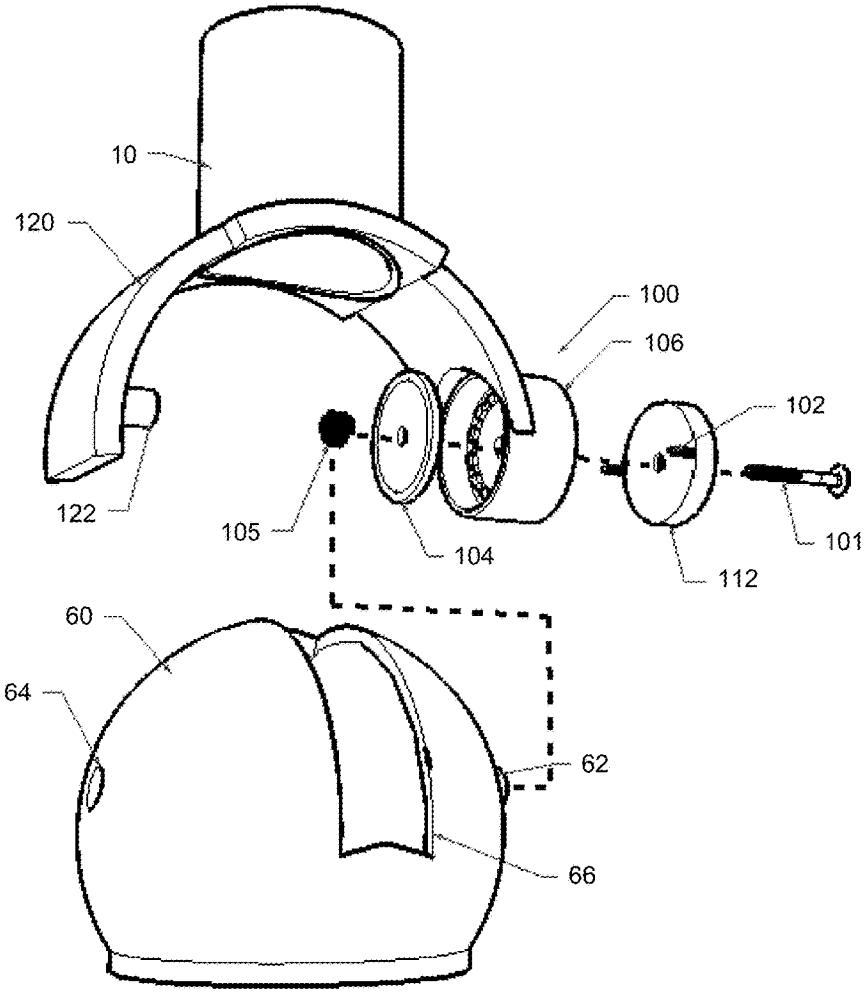

FIGS. 6-7 are isometric exploded views that show the rotating head of the example cleaning brush 5 at different angles of view. The socket arms 120 are attached to the brush head 60 by a head pin 122 that is fitted to a hole 64 in the brush head 60 and a rotary bolt 101 that is screwed into a threaded insert 62 fixed to the side of the brush head 60. The push button 112 may have a recessed center to conceal the rotary bolt 101. The push button 122 may have two push rods 102 that pass though the hub holes 103 on a swivel hub 106 to make contact with an outer ring of the hub drive 104. The hub drive 104 and the swivel hub 106 may have teeth that mate together to lock the brush head 60 in place. A spring 105 may be set over the rotary bolt 101 to press against the back side of the hub drive 104 and the end of the threaded insert 62. When the push button 112 is pressed, the push rods press on the hub drive 104 compressing the spring 105 and disengaging the locking teeth of the hub drive 104 and the swivel hub 106 allowing the brush head 60 to swivel. When the push button 112 is depressed, the spring 105 forces the hub drive 104 back into the swivel hub 106 locking the brush head 60 into place.

In an implementation, the hand pump cleaning brush includes a brush head with cleaning bristles, the brush head rotatably attached to a longitudinal handle member, the cleaning bristles mounted on the brush head in a plane non-perpendicular to a longitudinal axis of the longitudinal handle member, the brush head rotatable about an end of the longitudinal handle member for disposing the cleaning bristles in various non-perpendicular planes with respect to the longitudinal axis of the longitudinal handle member, a reservoir in the handle for containing a liquid cleaner, a pump for drawing ambient air and for drawing the liquid cleaner from the reservoir, the pump comprising a first piston for pumping the liquid cleaner, a second piston for pumping the ambient air, and an outer casing, the first piston and the second piston fixed along the longitudinal axis with respect to the longitudinal handle member and fixed to a mixing chamber, a discharge tube having a first end rotatably attached to the mixing chamber and a second end in rotatable fluid communication with the cleaning bristles, a trigger hinged to the longitudinal handle member and coupled to the outer casing of the pump to move the outer casing of the pump along the longitudinal axis of the longitudinal handle over the fixed first piston and the fixed second piston through mechanical force provided by a user, and a mesh at the second end of the discharge tube for aerating the liquid cleaner with the ambient air into a foam at the cleaning bristles through the mechanical force provided by the user.

In another implementation, a waterless foaming cleaning brush with adjustable brush head includes a tubular member comprising a handle having a longitudinal axis, a reservoir in the tubular member for containing a cleaning liquid, a pump in the tubular member having an axial stroke displacement along the longitudinal axis of the tubular member, a first piston of the pump for pumping a gas and having a radial diameter comparable to an inner diameter of the tubular member, a second piston of the pump within the first piston and concentric with the first piston for pumping the cleaning liquid, a trigger attached to an exterior of the tubular member to actuate an outer casing of the pump over the first piston and the second piston along the longitudinal axis, retracting the first piston and the second piston into the outer casing to displace a volume of the gas and the liquid cleaner within the outer casing, a mixing chamber attached to the pump for mixing the gas with the cleaning liquid, a discharge tube rotatably attached to the mixing chamber, a foaming screen attached to the discharge tube, a brush head rotatably connected to the tubular member, and cleaning bristles rotatably disposed on the brush head at a non-perpendicular angle with respect to the longitudinal axis, the cleaning bristles in foam communication with the discharge tube.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure.

The invention claimed is:

1. An apparatus, comprising:

a brush head with cleaning bristles, the brush head rotatably attached to a longitudinal handle member;

the cleaning bristles mounted on the brush head in a plane non-perpendicular to a longitudinal axis of the longitudinal handle member;

the brush head rotatable about an end of the longitudinal handle member for disposing the cleaning bristles in various non-perpendicular planes with respect to the longitudinal axis of the longitudinal handle member;

a reservoir in the handle for containing a liquid cleaner;

a pump for drawing ambient air and for drawing the liquid cleaner from the reservoir;

the pump comprising a first piston for pumping the liquid cleaner, a second piston for pumping the ambient air, and an outer casing;

the first piston and the second piston fixed along the longitudinal axis with respect to the longitudinal handle member and fixed to a mixing chamber;

a discharge tube having a first end rotatably attached to the mixing chamber and a second end in rotatable fluid communication with the cleaning bristles;

a trigger hinged to the longitudinal handle member and coupled to the outer casing of the pump to move the outer casing of the pump along the longitudinal axis of the longitudinal handle over the fixed first piston and the fixed second piston through mechanical force provided by a user;

a mesh at the second end of the discharge tube for aerating the liquid cleaner with the ambient air into a foam at the cleaning bristles through the mechanical force provided by the user; and wherein the reservoir is fixed to the outer casing of the pump and moves in unison with the outer casing of the pump with respect to the fixed first piston and the fixed second piston and with respect to the longitudinal handle member to actuate the pump, the reservoir and the outer casing of the pump moving under the mechanical force provided by the user through the trigger.

2. The apparatus of claim 1, further comprising a coiled tube to maintain the outer casing of the pump in fluid communication with the reservoir when the outer casing of the pump is moving with respect to the reservoir.

3. The apparatus of claim 1, wherein the cleaning bristles are removable.

4. The apparatus of claim 1, wherein the brush head can swivel to different angles with respect to the handle.

5. The apparatus of claim 1, wherein the reservoir has a clear viewing window.

6. A waterless foaming cleaning brush with adjustable brush head, comprising:

a tubular member comprising a handle having a longitudinal axis;

a reservoir in the tubular member for containing a cleaning liquid;

a pump in the tubular member having an axial stroke displacement along the longitudinal axis of the tubular member;

a first piston of the pump for pumping a gas and having a radial diameter comparable to an inner diameter of the tubular member;

a second piston of the pump within the first piston and concentric with the first piston for pumping the cleaning liquid;

a trigger attached to an exterior of the tubular member to actuate an outer casing of the pump over the first piston and the second piston along the longitudinal axis, retracting the first piston and the second piston into the outer casing to displace a volume of the gas and the liquid cleaner within the outer casing;

a mixing chamber attached to the pump for mixing the gas with the cleaning liquid;

a discharge tube rotatably attached to the mixing chamber;

a foaming screen attached to the discharge tube;

a brush head rotatably connected to the tubular member; and cleaning bristles rotatably disposed on the brush head at a non-perpendicular angle with respect to the longitudinal axis, the cleaning bristles in foam communication with the discharge tube.

7. The waterless foaming cleaning brush of claim 6, wherein the trigger actuates a stroke displacement of the pump along the longitudinal axis of the tubular member to produce a metered amount of a foam at the cleaning bristles.

8. The waterless foaming cleaning brush of claim 6, further comprising a spring to return the trigger and the outer casing of the pump to an initial position, wherein the first piston and the second piston are extended from the displacement within the outer casing of the pump.

9. The waterless foaming cleaning brush of claim 6 wherein at least one of the first piston and the second piston are fixed with respect to the tubular member and the trigger actuates an outer casing of the pump along the longitudinal axis to slide over the first piston and the second piston.

10. The waterless foaming cleaning brush of claim 9, wherein the reservoir is fixed with respect to the tubular member and the fixed reservoir is in liquid communication with the sliding outer casing of the pump via a coiled tube.

11. The waterless foaming cleaning brush of claim 9 wherein the reservoir is attached to the outer casing of the pump and the reservoir moves along the longitudinal axis in unison with the outer casing.

12. The waterless foaming cleaning brush of claim 6 wherein the cleaning bristles are removable and replaceable.

* * * * *